US005613682A

United States Patent [19]

Otuzbiryan

[11] Patent Number: 5,613,682

[45] Date of Patent: Mar. 25, 1997

[54] METHOD OF PLAYING A CARD GAME WHEREIN CARD VALUES ARE TOTALLED AND COMPARED

[76] Inventor: Ghirayr Otuzbiryan, 2310 Fairview #201, Burbank, Calif. 91504

[21] Appl. No.: 632,606

[22] Filed: Apr. 15, 1996

[51] Int. Cl.[6] ..... A63F 1/00

[52] U.S. Cl. ..... 273/292; 273/306

[58] Field of Search ..... 273/292, 274, 273/309, 306, 303

[56] References Cited

U.S. PATENT DOCUMENTS

| | | | |
|---|---|---|---|
| 5,141,234 | 8/1992 | Boylan et al. | 273/292 |
| 5,275,415 | 1/1994 | Wisted | 273/274 |
| 5,366,228 | 11/1994 | Kangsanaraks | 273/292 |
| 5,397,128 | 3/1995 | Hesse et al. | 273/292 |

OTHER PUBLICATIONS

"Anaconda" Hoyle's Modern Encyclopedia Of Card Games, Walter Gibson, Doubleday & Company, Inc., p. 241, 1974.

*Primary Examiner*—Benjamin H. Layno
*Attorney, Agent, or Firm*—Erik M. Arnhem

[57] ABSTRACT

A card game is played with a deck of cards having a full complement of face cards and a partial complement of numbered cards. Each card has a designated point value, with object being to achieve a hand having the highest point value. Each player receives four cards; one card is discarded, leaving three cards to be combined to achieve the point value for the hand. Cards of the same suit can be added together to provide a total point value for the hand. Alternately, points can be awarded for a hand containing three cards of the same kind, e.g. three kings or three sevens. The game is played according to the rules used in blackjack.

6 Claims, 1 Drawing Sheet

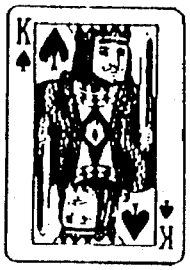
AND
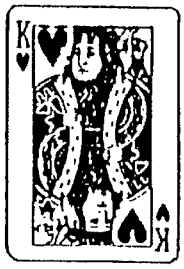
AND
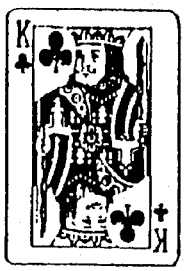
= 33
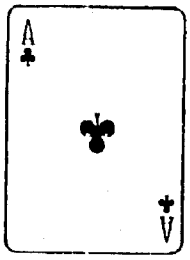
AND
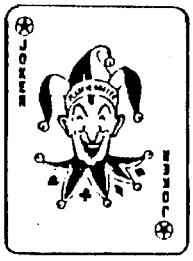
AND
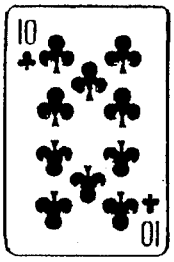
= 32
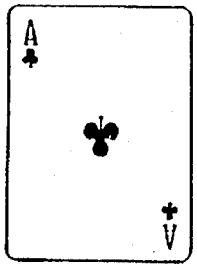
AND
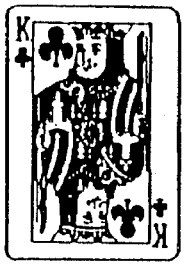
AND
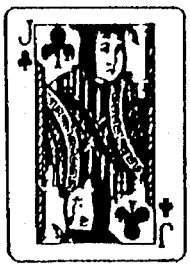
= 31
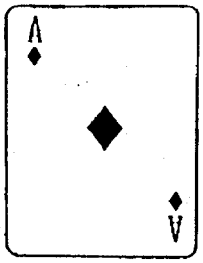
AND
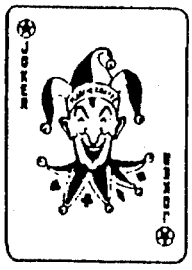
AND
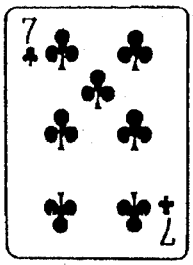
= 22
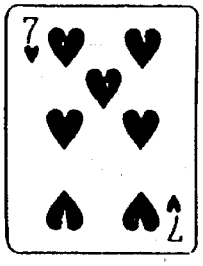
AND
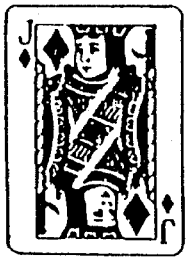
AND
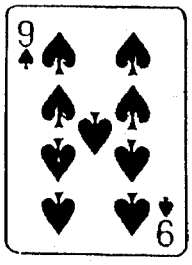
= 10

METHOD OF PLAYING A CARD GAME WHEREIN CARD VALUES ARE TOTALLED AND COMPARED

BACKGROUND AND SUMMARY OF THE INVENTION

This invention relates to a card game that is played similarly to blackjack, but using a deck of cards that has only a partial complement of numbered cards. The conventional deck of fifty two cards is modified by removing the numbered cards two through six, so as to achieve a playing deck containing thirty three cards. The playing deck includes all of the aces, all numbered cards seven through ten, all of the face cards jack through king and a single joker.

Each face card has an assigned value of ten, each numbered card has its indicated value, each ace has an assigned value of eleven, and the joker has an assigned maximum value of eleven. The joker is a wild card that can be used as a face card or numbered card in any suit.

The game can be played like blackjack; i.e. the dealer plays his hand against the individual hands of the other players. Each player, including the dealer, is dealt four cards face down; only three of the cards in each hand are used. Each player discards the card that is of minimal value in achieving a winning hand.

The object of the game is to achieve a hand having the having the highest point total, using the above-noted values. To add interest to the game, the card values in any hand are added together only when the cards are in the same suit. For example, a hand containing the seven of spades, jack of spades and seven of diamonds would have a point total of 17 (the seven of spades plus the ten points for the jack of spades); the seven of diamonds would not enter into the calculation.

In order to add further interest to the game, the rules provide that a hand containing three of a kind (e.g. three Jacks or three eights) will have a point total of thirty three. Thirty three is the highest point total that can be achieved.

From the above, it can be seen that there are essentially two ways to achieve a winning hand, i.e. by having cards of the same suit totalling a high point value, or by having three cards of the same denomination, e.g. kings or nines. The highest point total possible is thirty three (obtained with a hand containing three of a kind). The highest point total achievable with cards of the same suit is thirty two (e.g. ace of diamonds, king of diamonds, and the joker).

The game is preferably played like blackjack. The dealer and each player receives four cards face down; one of the cards is discarded, leaving three cards in each hand. All four cards can be dealt to each player in a single dealing sequence around the table. Alternately, each player can be dealt three cards face down; each player looks at his hand and discards one of the cards that he believes has minimal value. The fourth card is then dealt to each player, such the player has a hand containing three cards.

The dealer-banker plays his hand against the hands of the individual players, similarly to the procedure used in blackjack. The winning hand is the hand with the highest point total, achievable either by having three of a kind or by having a high point total in any single suit. The joker is a wild card that can be used as one of the cards in a three-of-kind hand, or as a high card in any particular suit.

One feature of the game is that only cards in the same suit can be added together, to achieve a high point total.

Another feature of the invention is that relatively high point totals are achievable (because each hand contains three cards). This feature tends to reduce the possibilities for tie game situations.

A further feature of interest is that each player has multiple ways to achieve a winning hand; i.e. with a hand containing three of a kind, or with a hand having a high point total.

A further interesting feature is the use of the joker as a wild card. The wild card increases the number of combinations that can be used to achieve a winning hand, thereby adding to the game enjoyment.

There are some patents disclosing variants of the game of blackjack. However, none of the patented games is believed to follow the precise concept involved in the present invention. The game herein disclosed is believed to be patentably distinct from the games of the prior art.

U.S. Pat. No. 5,368,305, ganted to J. Rodda et al, describes a gard game that is played with the eights, nines and tens removed from the deck. Each ace through seven has its indicated point value, and each face card has a value of one half point. The object of the game is to achieve a hand totalling as close as possible to seven and one half points, without exceeding that figure.

U.S. Pat. No. 5,397,128, granted to M. Hesse, describes a card game wherein each ace has an assigned value of one, each 2 through 6 and 9 has its indicated value, and each face card has a value of zero; each seven, eight and ten is removed from the deck. The players attempt to have hands coming as close as possible to nine without exceeding that value. Each player receives three cards, with the option to receive one additional card. The game is a variation on the game of blackjack.

U.S. Pat. No. 5,314,193, granted to Emilio Ferrer, describes a card game in which the cards have designated point values. The object of the game is to hold a hand having a high point total that includes one half point. The face cards have a value of one half point, thereby enabling each player to achieve the desired high point card values containing the one half point valuation.

U.S. Pat. No. 5,366,228, granted to a. Kangsanaraks, discloses a card game wherein the winning hand is the hand that has the highest total value closest to nine. Each player receives two cards, with the option to receive a third card. The aces have a value of one, the numbered cards have their indicated values, and the face cards have a value of zero. The game is played similarly to the game of blackjack.

The game of the present invention is played with a deck of cards that includes one joker, a full complement of face cards, and a partial complement of numbered cards; cards numbered two through six are removed from the deck. The joker can be used as a wild card, to serve as any face card or numbered card in the deck.

The game is played, using the procedures employed in the game of blackjack. A player can win by holding three of a kind, or by holding multiple cards in the same suit totalling a high point value.

Further features and procedures employed in the game of the present invention will be apparent from the attached drawing and description of the game rules, as explained in the specification.

THE DRAWINGS

The single FIGURE shows five representative hands and the corresponding point values, using the rules and game procedures of the present invention.

DESCRIPTION OF A PREFERRED EMBODIMENT OF THE INVENTION

The game is played with a standard deck of cards, modified by removing all of the cards from two through six. This provides a playing deck of thirty three cards, that include all of the face cards, all of the aces, all of the numbered cards from seven through ten inclusive, and a single joker.

Each face card has an assigned value of ten; each numbered card has its indicated value; each ace has an assigned value of eleven; and the single joker has an assigned maximum value of eleven. The joker is a wild card that can be used as any card in the deck. The rules provide that any hand containing three cards of the same denomination (e.g. three jacks or three sevens) will have a point total of thirty three. The rules further provide that point values for cards in the same suit (in any given hand) can be added together to give a total point value for the hand. For example, a hand containing the seven of hearts, eight of hearts and king of spades would have a point value of fifteen, i.e. seven plus eight; the king of spades would be disregarded in this calculation.

The object of the game is to obtain a hand having a high total point value; the maximum point value is thirty three. This high point value can be achieved either by holding three-of-a-kind, or by holding high cards of the same suit, e.g. spades or hearts or diamonds or clubs.

The game is played according to the rules used in blackjack. One person is designated as the dealer-banker. The other players play their individual hands against the hand of the dealer-banker. Various procedures can be used to select the person who is to assume the duties of dealer-banker. For example, the dealer-banker can be selected by rolling dice, or by turning up cards. The selected person can serve as dealer-banker for a predetermined number of hands, after which the task can be assumed by another player, according to mutually-agreed procedures.

The dealer-banker deals four cards to each game participant, face down. Each game participant looks at his own cards, and discards one card, leaving three cards in his hand. The value of the hand is the total point value of the three cards.

The players turn up their cards for comparison with the cards in the dealer-banker's hand. There can be as many winners as there are players, typically five or six.

Various betting arrangements can be employed; for example, dealer deals cards in a first round to the seven players; first cards are dealt face down with second cards face up. The betting (or non betting) starts after second cards are dealt.

In a second round, third cards are dealt face up and betting starts again.

In a third round, cards are dealt face down with betting; etc., starting again.

Arrangements are made to determine who will be the first participant, to bet or check.

In preferred practice of the invention all four cards are dealt to each participant in a single continuous deal. However, as a variant, the dealing procedure can be such that three cards are initially dealt to each participant, with the fourth card being dealt after each participant has discarded one card (or at least has the option of discarding one card). With such a procedure, each participant is required to make a decision affecting the final point value of the hand. The game is changed from a game of chance to a game involving a mixture of chance and skill.

As noted previously, each game winner is the participant holding the hand having the higher point value (comparing each player's hand to the hand of the dealer-banker). The attached drawing shows some representative hands and the corresponding point values. One hand shown in the drawing consists of three kings having a value of thirty three points; similarly any hand containing three of a kind (e.g. three jacks) would have a value of thirty three points.

In a situation where the dealer-banker and the opposing player both have hands containing three of a kind, then the rules provide that the winner is the person holding the higher value cards; i.e. three aces will prevail over three jacks or three tens.

The drawing shows a second hand consisting of an ace, king and jack of clubs. Since all three cards are in the same suit, they can be added together to achieve a relatively high point value of thirty one (the ace has a value of eleven, and each face card has a value of ten).

The drawing shows a third hand consisting of the ace of diamonds, the joker, and the seven of clubs. In this hand the seven of clubs has no value. The joker can be used as the king of diamonds, giving the hand a value of twenty one points (eleven for the ace and ten for the king).

The drawing shows a fourth hand consisting of the seven of hearts, jack of diamonds, and nine of spades. These cards are in different suits, and therefore cannot be added together to give a high total value. The hand has a value of ten (i.e. the value of the jack).

It can be seen from the drawing that the point values for different hands can vary widely. This feature tends to minimize the potential for tie games. Another interesting feature is that each participant has multiple ways to win; i.e. with a hand containing three of a kind, or with a hand having a high point total. The use of the joker as a wild card adds further interest to the game.

The game is played with a deck of cards having only a partial complement of numbered cards. Cards numbered two through six are removed from the deck, leaving only a partial complement of numbered cards (i.e. seven through ten). This is done primarily to increase the possibilities of drawing a hand containing three of a kind.

While the description has necessarily concentrated on a specific game embodiment, it will be appreciated taht some variations not specifically stated herein can be employed without departing from the inventive concept.

For example, a variant would be a rule wherein two cards of the same kind would have a designated point value, or a point value related to the denomination of the cards in the pair, i.e. a pair of aces could have a higher value than a pair of tens.

The limits of the invention are enumerated in the attached claims.

What is claimed is:

1. A method of playing a card game among two or more players, comprising:

providing a deck of playing cards containing a joker, a full complement of aces and face cards, and a partial complement of numbered cards;

providing a dealer-banker and at least one player;

dealing four cards face down to the dealer-banker and each player;

said dealer-banker and each player discarding one card, leaving three cards in each hand; and exposing the cards in each hand, to determine the winning hands, according to the following rules:

(a) each face card has a value of ten;
(b) each numbered card has its indicated value;
(c) each ace has a value of 11;
(d) the joker has a maximum value of 11;
(e) the joker is a wild card that can be used as a face card or numbered card in any suit;
(f) each individual player plays his hand against the dealer-banker's hand; and
(g) the winning hand is the hand having the highest point totals in any one suit.

2. The method of claim 1, wherein the rules further provide:

(h) a hand containing three cards of the same value will prevail over any other hand;
(i) as respects competing hands containing three cards of the same value, the winner will be the hand having the higher numerical value, in descending fashion from the ace to the lowest numberd card.

3. The method of claim 1, wherein the partial complement of numbered cards consists of the cards numbered seven through ten.

4. The method of claim 1, wherein cards numbered two through six are removed from the deck to achieve the partial complement of numbered cards.

5. A method of playing a card game among two or more players, comprising:

providing a deck of cards containing a joker, a a full complement of face cards and aces, and a partial complement of numbered cards;

providing a dealer-banker and at least one player;

dealing four cards face down to the dealer-banker and each player;

said dealer-banker and each player discarding one card, leaving three cards in each hand; and exposing the cards in each hand, to determine the winning hands, according to the following rules:
(a) each face card has an assigned value of ten;
(b) each numbered card has its indicated value;
(c) each ace has an assigned value of 11;
(d) the joker has an assigned maximum value of 11;
(e) the joker is a wild card that can be used as a face card or numbered card in any suit;
(f) each individual player plays his hand against the dealer-banker's hand;
(g) the winning hand is the hand containing three cards of the same denomination, or the hand having the highest point total in any one suit;
(h) a hand containing three cards of the same denomination will prevail over any other hand;
(i) as respects competing hands containing three cards of the same denomination, the winner will be the hand having the higher value, in descending fashion from the ace to the lowest numbered denomination;
(j) as respects competing hands having the same point total in any one suit, the winner will be the hand having the highest value card in another suit.

6. The method of claim 5, wherein the partial complement of numbered cards consists of cards numbered seven through ten.

* * * * *